United States Patent [19]

Hill

[11] Patent Number: 4,672,706

[45] Date of Patent: Jun. 16, 1987

[54] TOOTHBRUSH

[75] Inventor: Percy H. Hill, Silver Lake, N.H.

[73] Assignee: Stratford Laboratories, Englewood Cliffs, N.J.

[21] Appl. No.: 813,748

[22] Filed: Dec. 27, 1985

[51] Int. Cl.[4] ..... A46B 9/04

[52] U.S. Cl. ..... 15/167 R; 15/143 R; D4/104

[58] Field of Search ..... 15/167 R, 167 A, 143 R; D4/104–112

[56] References Cited

U.S. PATENT DOCUMENTS

| | | | |
|---|---|---|---|
| D. 240,981 | 8/1976 | Hill | D4/104 |
| D. 255,511 | 6/1980 | Hill et al. | D4/104 |
| 2,263,885 | 11/1941 | McGauley | 15/143 R |
| 2,414,775 | 1/1947 | Stavely | 15/167 R |
| 4,351,080 | 9/1982 | Grossman | 15/167 R |
| 4,519,111 | 5/1985 | Cavazza | 15/167 R |

*Primary Examiner*—Peter Feldman
*Attorney, Agent, or Firm*—Norman E. Lehrer

[57] ABSTRACT

An ergonomically designed toothbrush includes a handle of rectangular cross-sectional configuration. The handle is twisted about its longitudinal axis so that it fits the palm of a person's hand providing a power grip yet will fit most toothbrush holders. The forward end of the handle tapers outwardly and has an elliptical cross-sectional configuration with its outer surface being textured for ease of manipulation and comfort. A small elliptical neck connects the brush head to the handle and is designed not to interfere with the lips or cheeks when brushing. The brush head includes multi-level tufts of two grades of stiffness arranged in offset rows and is designed to remove plaque from interproximal areas as well as tooth surfaces and to reach into the gingival margin to gently massage the gums.

11 Claims, 11 Drawing Figures

TOOTHBRUSH

BACKGROUND OF THE INVENTION

The present invention is directed toward a toothbrush and more particularly toward a totally ergonomically designed toothbrush.

Attempts have been made in the past to design toothbrushes which are more effective and easier to utilize than conventional toothbrushes. Examples can be seen in U.S. Pat. Nos. Des. 240,981 and Des. 251,038. Each of these prior art toothbrushes includes a handle portion and a brush which is connected to the handle portion through a narrow neck which is bent slightly upwardly so that the brush forms an angle with respect to the handle. The brush itself includes a plurality of rows of tufts with the bristles in the outer rows being longer than the bristles in the inner rows.

The toothbrushes in these two prior patents have been somewhat effective in allowing the user to more easily reach certain areas of the mouth. However, the arrangement of the bristles does not allow the brush to effectively remove plaque in interproximal areas. Furthermore, the handles of these toothbrushes and most other toothbrushes on the market are too narrow for the user to get a tight grip thereon. But the dimensions of the handle cannot be increased since this would prevent the toothbrush from fitting into most toothbrush holders.

SUMMARY OF THE INVENTION

The present invention is believed to overcome all of the deficiencies of the prior art described above. The ergonomically designed toothbrush of the present invention includes a handle of rectangular cross-sectional configuration. The handle is twisted about its longitudinal axis so that it fits the palm of a person's hand providing a power grip yet will fit most toothbrush holders. The forward end of the handle tapers outwardly and has an elliptical cross-sectional configuration with its outer surface being textured for ease of manipulation and comfort. A small elliptical neck connects the brush head to the handle and is designed not to interfere with the lips or cheeks when brushing. The brush head includes multi-level tufts of two grades of stiffness arranged in offset rows and is designed to remove plaque from interproximal areas as well as tooth surfaces and to reach into the gingival margin to gently massage the gums.

BRIEF DESCRIPTION OF THE DRAWINGS

For the purpose of illustrating the invention, there is shown in the accompanying drawings one form which is presently preferred; it being understood that the invention is not intended to be limited to the precise arrangements and instrumentalities shown.

DETAILED DESCRIPTION OF THE PREFERRED EMBODIMENT

Figure 1:
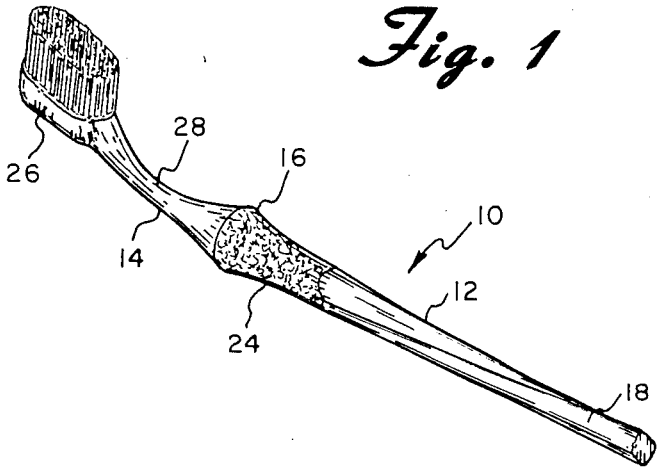
FIG. 1 is a perspective view of a toothbrush constructed in accordance with the principles of the present invention.
Figure 2:
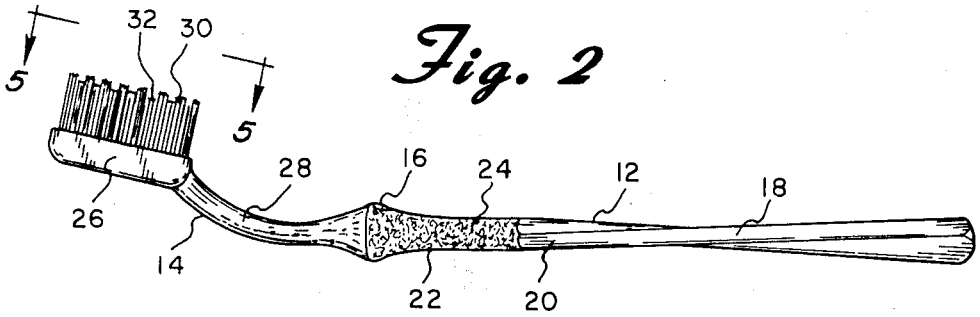
FIG. 2 is a side elevational view thereof.
Figure 3:
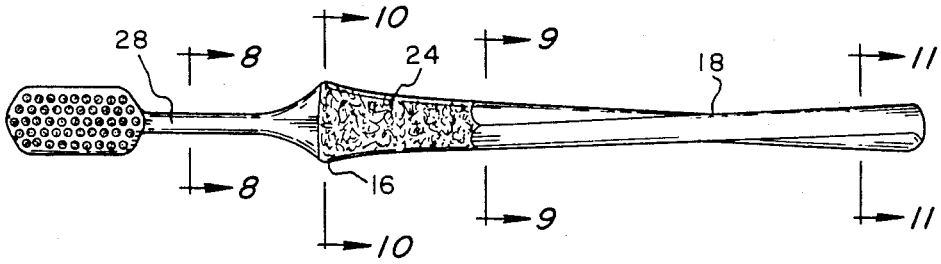
FIG. 3 is a top plan view thereof.
Figure 4:
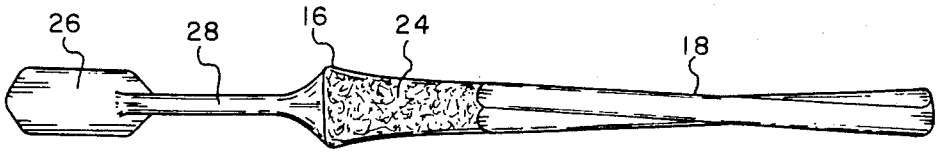
FIG. 4 is a bottom plan view thereof.

Referring now to the drawings in detail wherein like reference numerals have been used throughout the various figures to designate like elements, there is shown in FIGS. 1–4 an ergonomically designed toothbrush constructed in accordance with the principles of the present invention and designated generally as 10. FIG. 1 is a perspective view of the toothbrush 10 whereas FIGS. 2, 3 and 4 show the side, top and bottom of the toothbrush, respectively.

Figure 11:
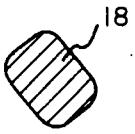
FIG. 11 is a cross-sectional view taken through the line 11—11 of FIG. 3.

Toothbrush 10 is comprised essentially of two parts which are integrally formed. These are a handle member 12 and a head member 14 which is connected to the forward end 16 of the handle member 12. As shown most clearly in FIGS. 1–4, a substantial portion of the handle member 12 is substantially rectangular in cross section. This portion is designated as 18 and the rectangular cross section thereof can clearly be seen from FIG. 11. Portion 18 of the handle 12 is twisted about its longitudinal axis through an angle of approximately 45° from one end to the other. That is, each face of the rectangular cross-sectional portion is offset from itself by an angle of approximately 45°. This is, perhaps, best shown in FIG. 2 wherein the face 20 at the forward end of the handle member is substantially vertically oriented whereas the same face 20 is at an angle of approximately 45° from the vertical at the remote end of the handle member. The twisted handle portion 18 fits the palm of a person's hand better than a straight rectangular handle and actually feels as if the handle is substantially larger in cross-sectional dimension thereby providing a more powerful grip. The handle will, however, fit into most toothbrush holders.

Figure 10:
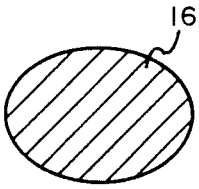
FIG. 10 is a cross-sectional view taken through the line 10—10 of FIG. 3.

The cross-sectional configuration of the forward end 16 of the handle member 12 is substantially larger than the cross section of the twisted rectangular portion 18. In addition, as shown most clearly in FIG. 10, the forward end 16 has a substantially elliptical cross section.

Located between the forward end 16 and the rectangular handle portion 18 is a transitional portion which tapers downwardly from the larger diameter at the forward end 16 to a smaller cross section as it joins the rectangular portion 18. The cross-sectional configuration of the transitional portion 22 is substantially elliptical and the outer surface 24 thereof is textured to provide a nonslip gripping surface for ease of manipulation, comfort and control.

Figure 8:
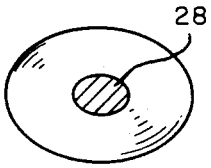
FIG. 8 is a cross-sectional view taken through the line 8—8 of FIG. 3.
Figure 9:
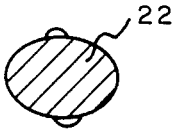
FIG. 9 is a cross-sectional view taken through the line 9—9 of FIG. 3.

The head member 14 of the toothbrush 10 includes a brush 26 and an elongated narrow neck 28. The neck 28 is long enough to promote brushing of difficult to reach areas and has a relatively small elliptical cross section as shown in FIG. 8 so that it will not interfere with the person's lips or cheeks when brushing. The neck portion connects the brush 26 to the forward end 16 of the handle member 12 and is curved upwardly as shown in FIG. 2 so that the brush 26 is located approximately between 10° and 15° above the longitudinal axis of the handle member 12.

Figure 5:
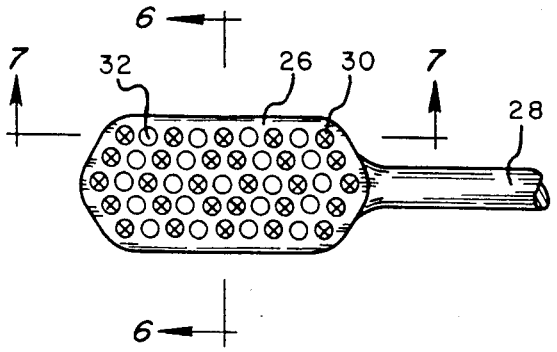
FIG. 5 is a top plan view shown partially in schematic form of the brush portion of the toothbrush.

As shown most clearly in FIGS. 3 and 5, the brush 26 includes a plurality of tufts of bristles arranged in horizontal rows as viewed in these figures. In the preferred embodiment, there are five rows of tufts but the invention will function satisfactorily with three or more such rows. The tufts in each row are offset from the tufts in the next adjoining row either above or below. As a result of this pattern, more tufts and, therefore, more bristles can be arranged per unit area. Also, because of this closer packing, the tufts from each row mutually support the tufts from the row above or below as the bristles are flexed making them more efficient particularly as they wear. Even further, this mutual support allows for the use of thinner filaments. Thinner filaments are desirable since they create less tooth surface wear. Because of this unique pattern, thinner filaments have the feel of substantially harder ones.

Figure 6:
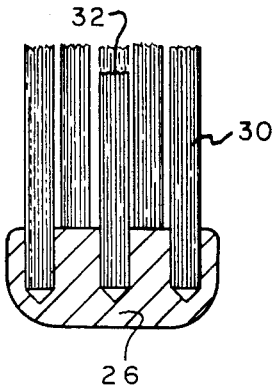
FIG. 6 is a cross-sectional view taken through the line 6—6 of FIG. 5.
Figure 7:
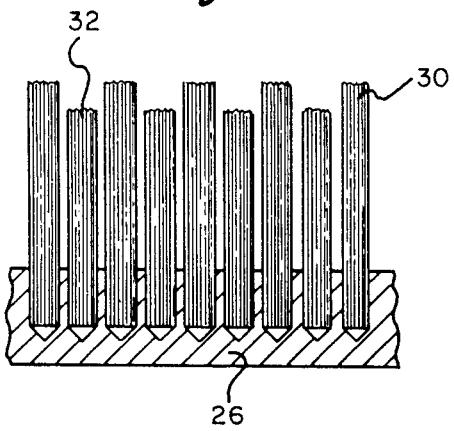
FIG. 7 is a partial cross-sectional view taken through the line 7—7 of FIG. 5.

The height of the filaments in the tufts in each row also vary as shown in FIGS. 5, 6 and 7. Although the pattern may vary somewhat, substantially every other tuft of filaments in each row is higher and the tufts in between are shorter. For illustration purposes, the tufts marked with an "X" such as tuft 30 in FIG. 5 are higher than the strands in the tufts marked "O" such as tuft 32. The taller tufts 30 are preferably made of a thinner filament than the shorter tufts 32 and, accordingly, there can be more strands in the same size tuft. As shown in FIG. 5, there are 28 tufts such as tuft 30 of the taller strands and 21 tufts such as tuft 32 of the shorter strands. It sould be readily apparent, however, that this is by way of example only.

The multi-level tufts of two different diameter filaments and, therefore, two different grades of stiffness which are distributed throughout the brush makes the toothbrush 10 useful for brushing the gingival margin and for cleaning surface plaque similar to the prior art brushes discussed above. However, the present brush is also effective for removing plaque from the interproximal areas.

In the preferred embodiment of the invention, the overall length of the toothbrush 10 is approximately 7½ inches.

The handle member 12 has an overall length of approximately 4¾ inches with the rectangular cross-sectional portion having a length of approximately 3½ inches. The rectangular cross section is approximately 0.25 inch by 0.30 inch. The forward end 16 of the handle 12 has a minor diameter of approximately 0.45 inch and a major diameter of approximately 0.625 inch.

Also, in the preferred embodiment, the neck 28 has a length of approximately 1½ inches and has a minor diameter adjacent its midpoint of approximately 0.14 inch and a major diameter of approximately 0.19 inch. The brush is approximately 1 inch long by ½ inch wide. For a medium brush, the longer tufts 30 are preferably comprised of 46 strands (92 ends) 0.007 polyester which are trimmed and polished to approximately 0.468 inch. The shorter tufts 32 are comprised of 30 strands (60 ends) 0.01 polyester which are trimmed and polished to approximately 0.406 inch. For a softer brush, 40 strands of 0.006 polyester and 30 strands of 0.008 polyester may be used for the longer and shorter tufts, respectively.

It should be readily apparent to those skilled in the art that the foregoing described dimensions are by way of example only and represent the preferred embodiment of the invention. It is possible to vary these dimensions and the arrangement of the components somewhat and still achieve the desired features. It should be clear, therefore, that the present invention may be embodied in other specific forms without departing from the spirit or essential attributes thereof and, accordingly, reference should be made to the appended claims rather than to the foregoing specification as indicating the scope of the invention.

I claim:

1. A toothbrush comprising:

a handle member and a head member connected to the forward end of said handle member;

said handle member being rectangular in cross section throughout a substantial portion thereof, said rectangular cross-sectional portion being twisted about its longitudinal axis whereby each face of said rectangular cross-sectional portion is offset from itself by an angle of approximately 45° from one end to the other thereof;

said handle member having a substantially larger cross-sectional configuration at its forward end where it connects to said head member and including a transitional portion which tapers downwardly from said forward end to said rectangular cross-sectional portion, the outer surface of said transitional portion being textured to provide a nonslip gripping surface thereon;

said head member including a brush and an elongated narrow neck portion connecting said brush to the forward end of said handle member;

said neck portion being curved upwardly so that said brush is located approximately between 10° and 15° above the longitudinal axis of said handle member;

said brush having at least three rows of a plurality of tufts of bristles, the tufts in each row being offset from the tufts in the next adjoining row, some of the tufts in each row including strands which are thinner and longer than the strands in the remaining tufts.

2. The invention as claimed in claim 1 wherein the cross-sectional configuration of said forward end of said handle member is substantially elliptical.

3. The invention as claimed in claim 1 wherein the cross-sectional configuration of said transitional portion is substantially elliptical.

4. The invention as claimed in claim 1 wherein the cross-sectional configuration of said neck portion is substantially elliptical.

5. The invention as claimed in claim 1 wherein substantially every other tuft in each row of tufts is comprised of strands which are thinner and longer than the strands in the tufts therebetween.

6. A toothbrush comprising:

a handle member and a head member including a brush;

said head member including an elongated narrow neck portion connecting said brush to the forward end of said handle member, said neck portion being curved upwardly so that said brush is located approximately between 10° and 15° above the longitudinal axis of said handle member;

said handle member being rectangular in cross section throughout a substantial portion thereof, said rectangular cross-sectional portion being twisted about its longitudinal axis whereby each face of said rectangular cross-sectional portion is offset from itself by an angle of approximately 45° from one end to the other thereof;

said handle member having a substantially larger cross-sectional configuration at its forward end where it connects to said head member and including a transitional portion which tapers downwardly from said forward end to said rectangular cross-sectional portion, the outer surface of said transitional portion being textured to provide a nonslip gripping surface thereon.

7. The invention as claimed in claim 6 wherein said brush has at least three rows of a plurality of tufts of bristles, the tufts in each row being offset from the tufts in the next adjoining row, some of the tufts in each row including strands which are thinner and longer than the strands in the remaining tufts.

8. The invention as claimed in claim 6 wherein the cross-sectional configuration of said forward end of said handle member is substantially elliptical.

9. The invention as claimed in claim 6 wherein the cross-sectional configuration of said transitional portion is substantially elliptical.

10. The invention as claimed in claim 6 wherein the cross-sectional configuration of said neck portion is substantially elliptical.

11. The invention as claimed in claim 7 wherein substantially every other tuft in each row of tufts is comprised of strands which are thinner and longer than the strands in the tufts therebetween.

* * * * *